United States Patent [19]

Leistikow

[11] 3,959,922

[45] June 1, 1976

[54] PUSH TOY ADAPTED TO PICK UP THREE-DIMENSIONAL OBJECTS LYING ON A SUPPORTING SURFACE

[75] Inventor: Gerard K. Leistikow, San Pedro, Calif.

[73] Assignee: Mattel, Inc., Hawthorne, Calif.

[22] Filed: May 16, 1975

[21] Appl. No.: 578,285

[52] U.S. Cl. ..... 46/205; 15/41 R; 46/40; 46/141

[51] Int. Cl.[2] ..... A63H 33/30

[58] Field of Search ..... 46/40, 202, 204, 205, 46/141, 144; 15/41 R; 198/7 R

[56] References Cited

UNITED STATES PATENTS

| | | | |
|---|---|---|---|
| 1,267,304 | 5/1918 | Adams | 15/41 R UX |
| 2,287,133 | 6/1942 | Reiter | 46/202 X |
| 2,508,454 | 5/1950 | Goodwin | 56/328 |
| 2,960,791 | 11/1960 | Reed | 46/205 |
| 3,080,592 | 3/1963 | Hassage | 15/50 |
| 3,097,383 | 7/1963 | Taylor | 15/41 R |
| 3,153,476 | 10/1964 | Barendsen et al. | 198/128 |
| 3,668,730 | 9/1970 | Scharmann et al. | 15/83 |

FOREIGN PATENTS OR APPLICATIONS

| | | | |
|---|---|---|---|
| 874,261 | 4/1953 | Germany | 46/40 |
| 921,344 | 3/1963 | United Kingdom | 46/41 |

*Primary Examiner*—F. Barry Shay
*Attorney, Agent, or Firm*—Stephen L. King; John G. Mesaros; Max E. Shirk

[57] ABSTRACT

A wheeled push toy, which may simulate a lawn mower, has an impeller which is rotated into engagement with objects to be picked up and flips them up a ramp into a collection container. The impeller is made of soft spongy material and is supported from the ends without provision of a center shaft. The device has a ring gear for driving the impeller, and may simulate a lawn mower.

4 Claims, 3 Drawing Figures

10
12
14
16
18
20
22
23
24
26
28
30
32
34
36
38
40
42
44
46
48
50
52
54
56
58
60
62
64
66
68
70
72
74
76
78
80
82
84
86
88
90
91
92
94
96
98
100
102
104

10
12
14
16
18
20
23
24
26
30
36
42
44
50
60
62
68
72
74
76
78
80
82
84
86
98
100
104
106

12
14
74
76
80
82
84
86

PUSH TOY ADAPTED TO PICK UP THREE-DIMENSIONAL OBJECTS LYING ON A SUPPORTING SURFACE

BACKGROUND OF THE INVENTION

The background of the invention will be set forth in two parts.

1. Field of the Invention

The present invention pertains generally to the field of push toys and more particularly to a new and useful push toy adapted to pick up three-dimensional objects lying on a supporting surface.

2. Description of the Prior Art

The prior art known to applicant is listed by way of illustration, but not of limitation, in separate communications to the United States Patent Office.

The present invention exemplifies improvements over this prior art and over a similar push toy disclosed in abandoned application Ser. No. 577,967 filed May 15, 1975 and assigned to the assignee of the instant application.

SUMMARY OF THE INVENTION

It is an object of the present invention to provide a new and useful push toy adapted to pick up three-dimensional objects lying on a supporting surface.

Another object of the present invention is to provide a toy of the type described including a soft spongy impeller which is rotated into engagement with objects to be picked up and which is especially designed to conform itself to the shape of the objects and flip them up a ramp into a collection container.

According to the present invention, a push toy is provided for picking up three-dimensional objects lying on a supporting surface. The toy includes a chassis having an object inlet and an object outlet. A pair of wheels are rotatably mounted on the chassis and include ring gears which drive pinions connected to a soft, spongy impeller rotated by the wheels when the toy is pushed over the supporting surface. The rotating impeller engages the objects and flips them up a ramp and into a container which may be an open-topped catcher simulating a grass catcher on a lawn mower so that a child-user of the push toy may see the objects being discharged through the object outlet by the impeller. The impeller is preferably made from a soft spongy material, like polymeric foam, which will conform itself to large objects and move them into the container.

The features of the present invention which are believed to be novel are set forth with particularity in the appended claims. The present invention, both as to its organization and manner of operation, together with further objects and advantages thereof, may best be understood by reference to the following description taken in connection with the accompanying drawings in which like reference characters refer to like elements in the several views.

DESCRIPTION OF THE PREFERRED EMBODIMENT

Figure 1:
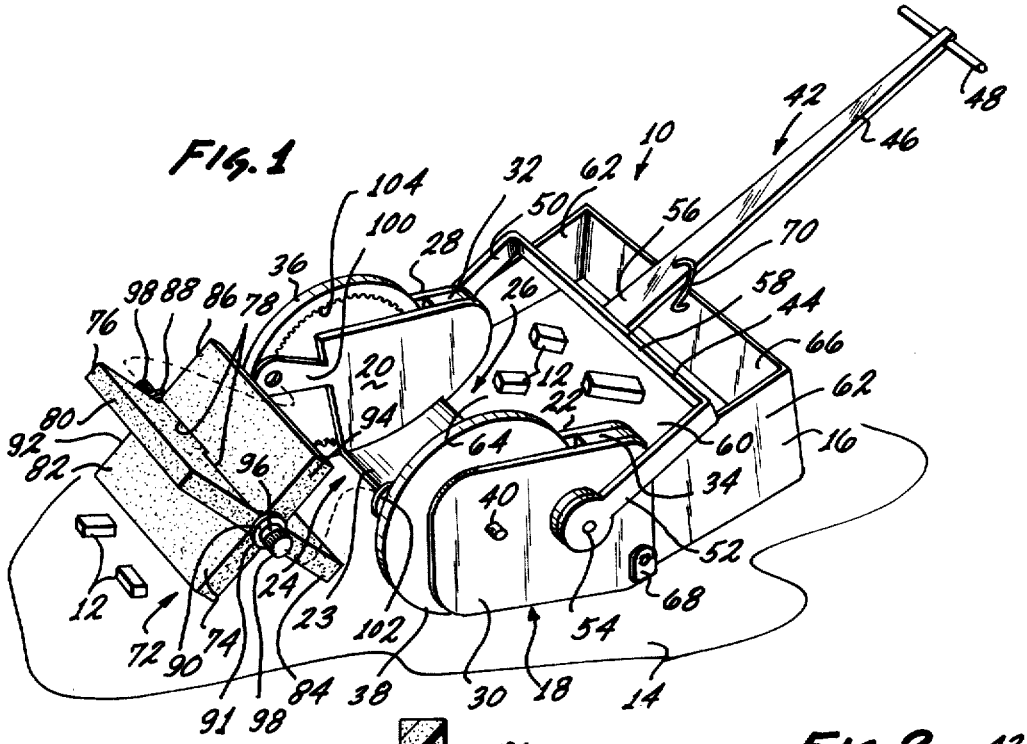
FIG. 1 is an exploded perspective view of a push toy constituting a presently preferred embodiment of the invention.

Referring again to the drawing, a push toy constituting a presently preferred embodiment of the invention, generally designated 10, is shown herein for purposes of illustration, but not of limitation, as simulating a lawn mower adapted to pick up three-dimensional objects 12 lying on a supporting surface 14 in the path-of-travel of toy 10 and discharge them into a collection container 16 which is preferably an open-topped receptacle simulating a grass catcher on a lawn mower. This gives a child-user an unobstructed view of the objects being discharged into container 16.

Push toy 10 includes a chassis 18 having a pair of inner plates 20, 22 connected together in spaced relation by a rearwardly, upwardly sloping ramp 23 to define an object inlet 24 and an object outlet 26. Chassis 18 includes a pair of outer plates 28, 30 maintained in parallel, spaced relation with plates 20, 22, respectively, by blocks 32, 34. A pair of wheels 36, 38 are rotatably mounted between these plates by suitable axles, like the one shown at 40 for wheel 38.

Push toy 10 also includes a handle assembly 42 having a yoke 44, a handle portion 46 and a transverse grip portion 48. The legs 50, 52 of yoke 44 are pivotally connected to plates 28, 30, respectively, by suitable pins, like the one shown at 54 for leg 52 and the lower end 56 of handle portion 46 is connected to the bight portion 58 of yoke 44.

Container 16 includes a comparitively rigid bottom wall 60 and a fairly flexible sidewall 62 upstanding from bottom wall 60 and defining an open front portion 64 and an open top portion 66. Suitable fasteners, like the one shown at 68, may be used to connect sidewall 62 to chassis 18 with open front portion 64 in communication with object outlet 26. A hook 70 may be used to connect container 16 to handle assembly 42.

Figure 2:
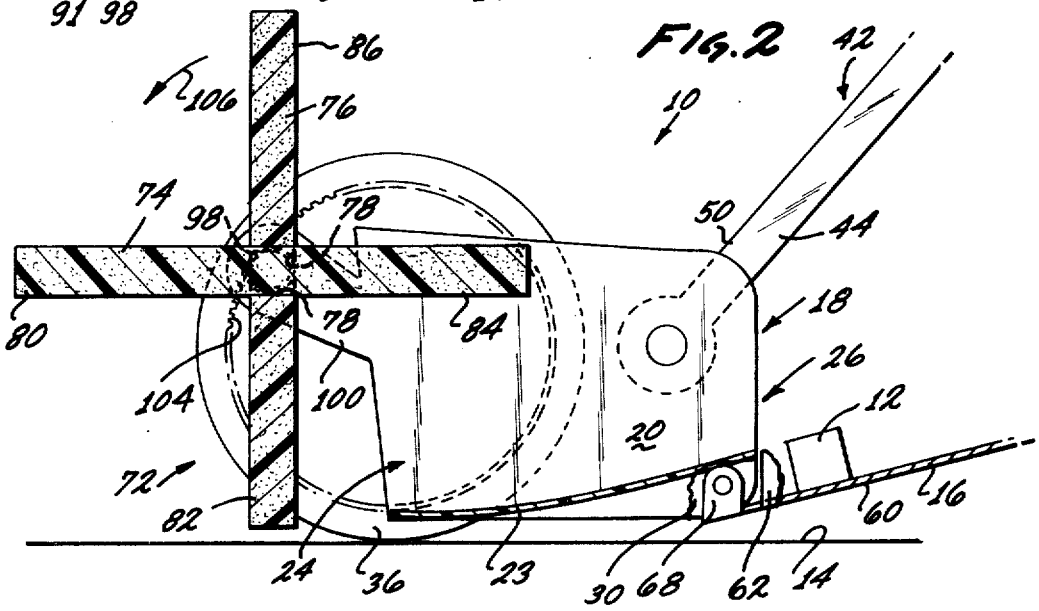
FIG. 2 is an enlarged, cross-sectional view of the push toy of FIG. 1.
Figure 3:
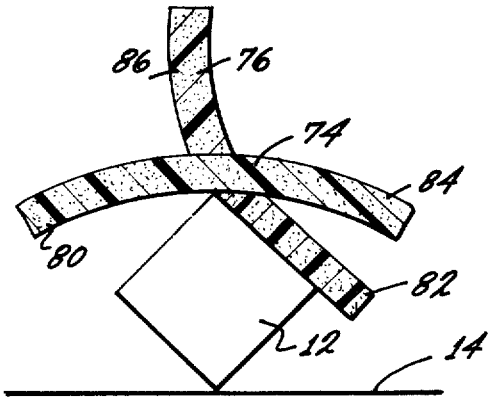
FIG. 3 is a somewhat diagramatic view of the toy of FIG. 1 showing the impeller conforming to the shape of an article to be picked up by the toy.

Push toy 10 also includes an impeller assembly 72 which may be made from two rectangular members 74, 76 each having a slot 78 (FIG. 2) extending half way through the midportion thereof so that the members 74, 76 may be connected together at right angles to each other by engaging their slots with each other as shown in FIG. 2. This forms a unitary structure without a center shaft and provides four separate impeller blades 80, 82, 84 and 86. These blades are preferably made from a soft spongy material, like polymeric foam, so that they will conform themselves to the shape of objects 12, as shown in FIG. 3, and grasp them for flipping them into container 16.

Impeller assembly 72 includes a pair of attachment members 88, 90 each having a disc portion 91 adhesively secured to ends 92, 94, respectively, of impeller assembly 72. Each attachment member 88, 90 also has a cylindrical hub 96 and a pinion 98 formed integrally with its disc portion 91. Hubs 96 are rotatably mounted in an associated one of the bosses 100, 102 extending forwardly from plates 20, 22, respectively, with pinions 98 extending into driving engagement with suitable ring gears, like the one shown at 104 on wheel 36.

Impeller assembly 72 may be rapidly rotated in the direction of arrow 106 by grasping grip portion 48 of handle assembly 42 and pushing toy 10 over surface 14 so that pinion gears 98 will be rotated by their ring gears 104.

Operation of push toy 10 is believed to be apparent and is briefly summarized at this point. A child-user may manipulate handle assembly 42 to guide chassis 18 over surface 14 on wheels 36, 38 which impart rotation to impeller assembly 72. Blades 80, 82, 84 and 86 will more-or-less grasp objects 12 by conforming to the shape thereof and will fling them through object inlet 24, up ramp 23, through object outlet 26 and into container 16.

Although the invention has been herein shown and described in what is conceived to be the most practical and preferred embodiment, it is recognized that departures may be made therefrom within the scope of the invention, which is not to be limited to the illustrative details disclosed.

What is claimed is:

1. In a push toy adapted to pick up three-dimensional objects lying on a supporting surface and having means for receiving said objects after they have been picked up, means for propelling said objects into said receiving means, said propelling means being aligned with said receiving means, means for positioning said propelling means over said objects, and means connected to said propelling means for moving it into engagement with said objects with a propelling force, the improvement wherein said propelling means comprises an impeller consisting of unitary structure made only of soft, spongy material, said structure having first and second ends, said means for moving said propelling means including a respective attachment member connected to each of said ends as the only means directly connected to said impeller for moving it, whereby the need for a center shaft for said impeller is eliminated.

2. A push toy adapted to pick up three-dimensional objects lying on a supporting surface, comprising:

a housing having an object inlet and an object outlet;

an impeller constructed only of soft, spongy material rotatably mounted in said housing across object inlet, said impeller having first and second ends;

means on said toy for moving said impeller into engagement with said objects with a propelling force, said means for moving said impeller including an attachment member connected to each of said ends as the only means directly connected to said impeller for imparting rotation thereto, whereby the need for a center shaft for said impeller is eliminated; and a container connected to said housing across said object outlet for receiving said objects when they are discharged through said object outlet by said impeller.

3. A push toy as stated in claim 2 said means for moving said impeller including:

a pair of wheels rotatably mounted on said housing;

a ring gear provided on each wheel; and a pinion gear on each of said attachment members and drivingly engaging one of said ring gears.

4. A push toy as stated in claim 2 wherein said container simulates a grass catcher on a lawn mower and has an open top so that said objects may be viewed as they are propelled into said container by said impeller.

* * * * *